United States Patent [19]

LaBate, II

[11] Patent Number: 4,634,106

[45] Date of Patent: Jan. 6, 1987

[54] DEVICE FOR PLACING SLAG RETENTION MEANS IN TAPPING CONVERTER

[76] Inventor: Michael D. LaBate, II, 115 Hazen Ave., Ellwood City, Pa. 16117

[21] Appl. No.: 779,136

[22] Filed: Sep. 23, 1985

Related U.S. Application Data

[63] Continuation-in-part of Ser. No. 631,988, Jun. 18, 1984, abandoned.

[51] Int. Cl.[4] ..... C21C 5/48

[52] U.S. Cl. ..... 266/236; 222/597; 266/272

[58] Field of Search ..... 266/271, 272, 236; 137/172; 272/597, 598, 591, 602, 594

[56] References Cited

U.S. PATENT DOCUMENTS

| | | | |
|---|---|---|---|
| 1,437,661 | 12/1922 | Kaiser et al. | 266/272 |
| 1,607,408 | 11/1926 | Mayes | 266/272 |
| 3,459,418 | 8/1969 | Ueshima et al. | 266/272 |
| 4,037,828 | 7/1977 | Terada et al. | 266/271 |
| 4,431,169 | 2/1984 | Fuzii et al. . | |
| 4,468,013 | 8/1984 | LaBate . | |
| 4,478,392 | 10/1984 | Fuzii et al. . | |

FOREIGN PATENT DOCUMENTS

| | | | |
|---|---|---|---|
| 1167498 | 3/1984 | Canada | 266/272 |
| 53614 | 3/1984 | Japan | 266/272 |

*Primary Examiner*—Christopher W. Brody
*Attorney, Agent, or Firm*—Harpman & Harpman

[57] ABSTRACT

A device for placing a slag retaining device in a tap hole in a converter consists of a boom extensible into the converter, jaws on the boom detachably hold the slag retaining device, fixed base apparatus for manipulating the boom movably mounted on a fixed platform adjacent the converter to forcefully move the boom longitudinally vertically and horizontally so as to push the slag retaining device through the layer of slag in the converter and into the tap hole.

3 Claims, 3 Drawing Figures

DEVICE FOR PLACING SLAG RETENTION MEANS IN TAPPING CONVERTER

This is a continuation-in-part of application Ser. No. 631,988 filed June 18, 1984 now abandoned.

BACKGROUND OF THE INVENTION

1. Technical Field

This invention relates to a device for accurately and forcefully positioning a slag retaining closure or dart in a tapping converter during the tapping of steel therefrom to prevent the floating slag from leaving the converter.

2. Description of the Prior Art

Prior structures of this type are best represented by the disclosures of U.S. Pat. Nos. 4,431,169, 4,478,392, 4,468,013 and, 4,553,743, issued Nov. 19, 1985, and pending application Ser. Nos. 733,911 and 747,799 in which closures are positioned in converters by arms adjustably and movably mounted adjacent the converters and which releasably hold the closures.

The present invention utilizes a telescopic boom similar to the arms of the prior art patents and provides a device for forcefully manipulating the boom enabling it to more efficiently move the closure or dart into the charging opening of the converter and then move it through the slag and molten metal and position it in the tap hole thereof. The prior art devices generally placed the closure or dart in the vortex of the flowing molten metal and slag and relied on the flow through the tap hole to locate and place the closure or dart in the tap hole.

SUMMARY OF THE INVENTION

A device for placing slag retention devices in tapping converts includes a pivotal support mounted on a platform adjacent a converter or a furnace and an elongated frame member extending from the pivotal support and supported at its outer end on wheels so as to be movable in an arcuate path spaced with respect to the pivotal support and between the pivotal support and the converter. A carriage is movably mounted on the frame and a telescopic boom is pivoted to the carriage and is movable into and out of the converter. Jaws on the end of the telescopic boom releasably engage the closure or dart when positioned in the tap hole of the converter.

DESCRIPTION OF THE PREFERRED EMBODIMENT

Figure 1:
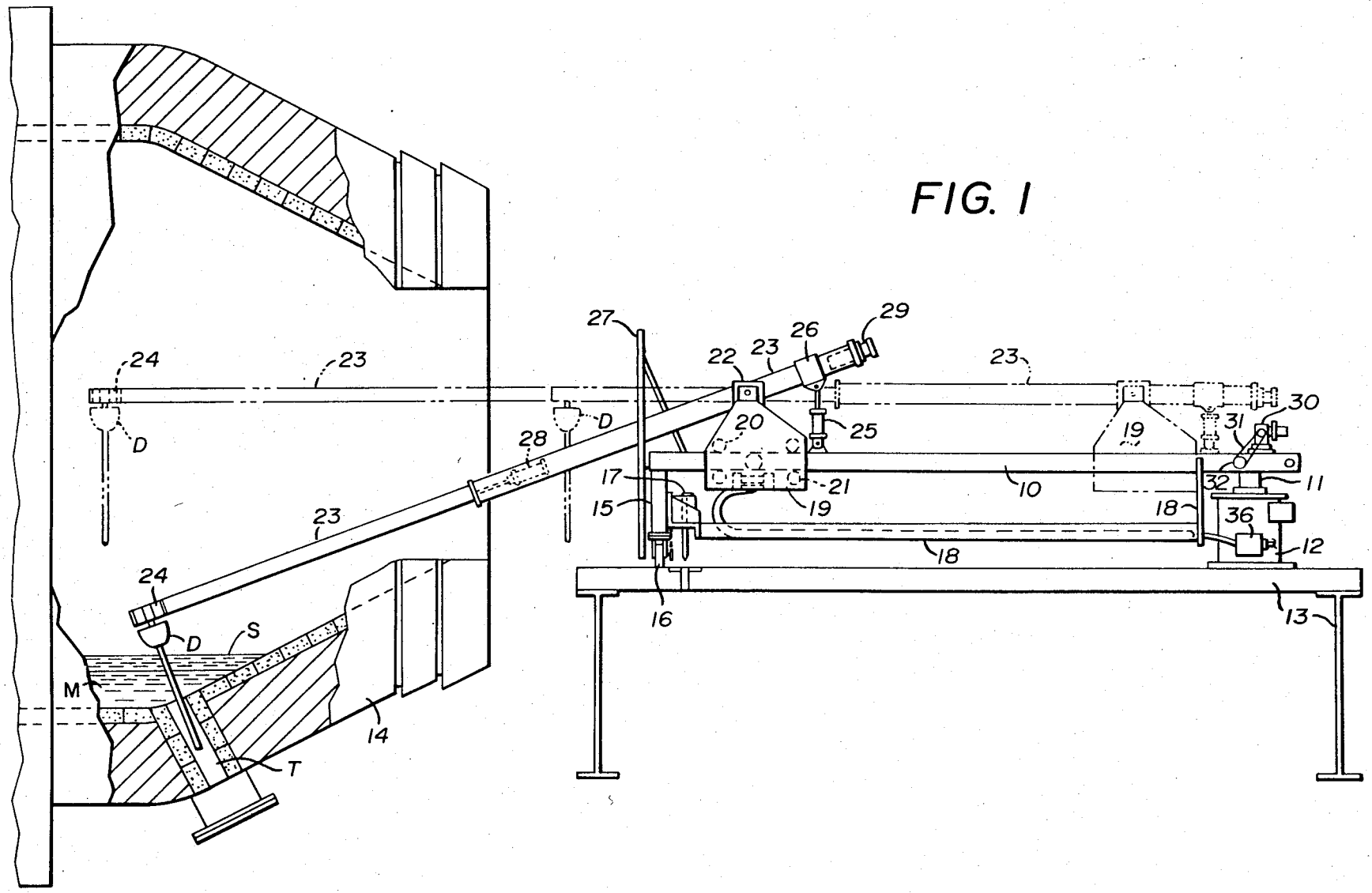
FIG. 1 is a side elevation of the device and a converter with parts broken away and parts in cross section, broken lines showing alternate positions.
Figure 2:
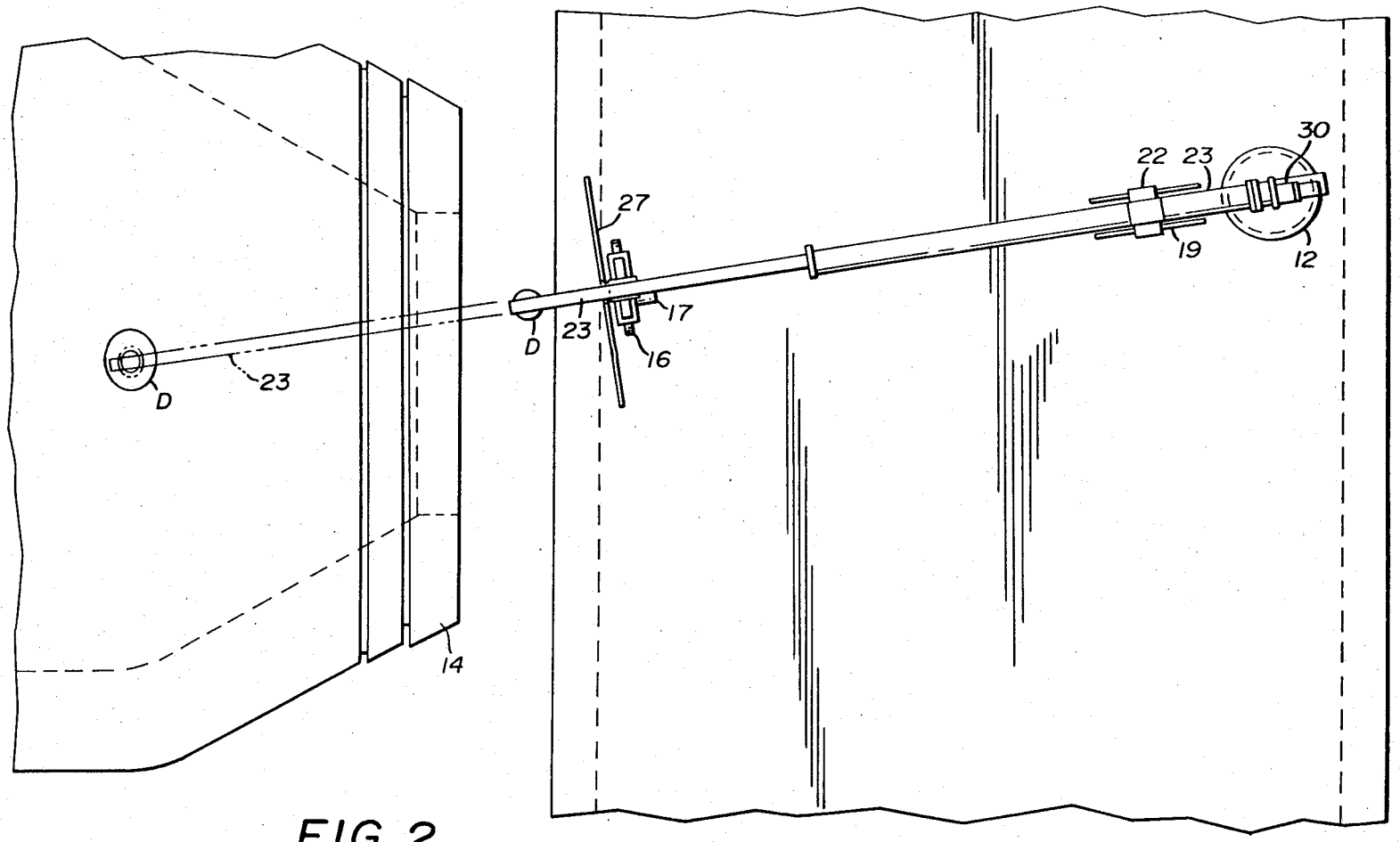
FIG. 2 is a top plan view of the device showing the same mounted for swinging motion relative to a pivotal support on a platform adjacent the converter.
Figure 3:
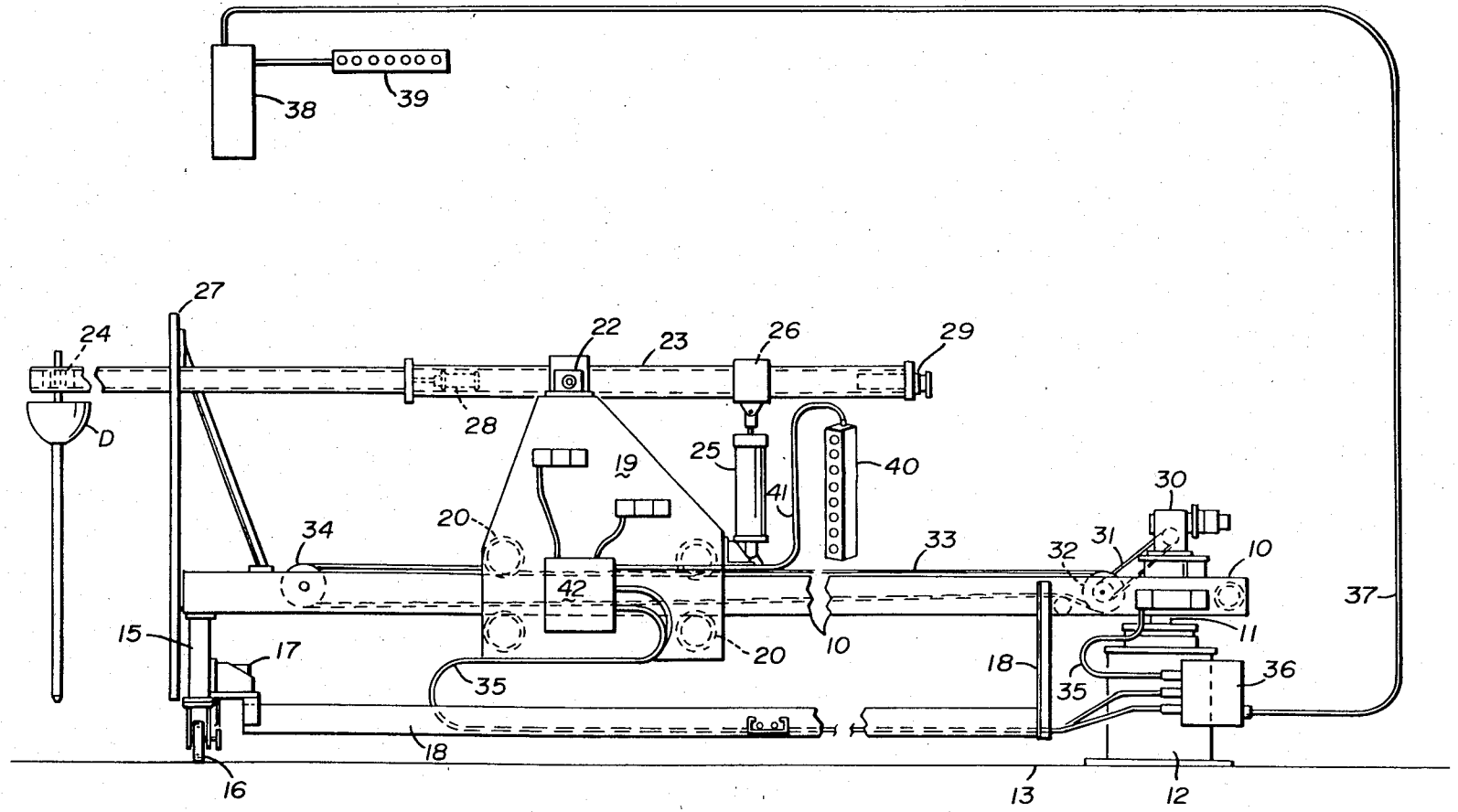
FIG. 3 is a side elevation of the device with parts broken away and wiring control circuits and switches in connection therewith.

The device for positioning slag retaining closures, such as darts, in tapping converters as used in the steel industry to prevent the flow of slag from the tap hole of the converter is illustrated in its simplest form in FIGS. 1,2 and 3 of the drawings and by referring to FIGS. 1 and 2 of the drawings, it will be seen that the device comprises a horizontally disposed frame formed of an elongated member 10 pivotally mounted at one end by a pivot 11 engaging a fixed pivotal support 12 which in turn is positioned on a platform 13 adjacent a converter generally indicated at 14. The frame includes a wheeled support 15 having wheels 16 thereon engaging the platform and carries a motor and drive means 17 by which the wheels 16 may be driven as best seen in FIG. 3 of the drawings.

An elongated channel 18 extends between the wheel support 15 and a support frame 18 carried by the elongated member 10 in spaced relation to the pivotal support 12. A carriage 19 is provided with upper and lower rollers 20 and 21 respectively engaging the upper and lower sides of the elongated member 10 of the horizontal frame, an upstanding bracket 22 is formed on the uppermost portion of the carriage 19 and pivotally mounts a telescopic boom 23 having at least two sections capable of extension into the interior of the converter 14 so as to position a dart or closure D in a tap hole T in the converter 14. Jaws 24 arranged for remote actuation are mounted on the free end of the telescopic boom 23 so as to releaseably engage the dart or closure D which is provided with a depending guide rod having a refractory coating to facilitate registry in the tap hole T in the converter 14 through slag layer S and metal M.

Still referring to FIG. 1 of the drawings, the carriage 19 will be seen to provide a movable mounting for a piston and cylinder assembly 25, the piston thereof being pivotally engaged on a bracket 26 attached to the telescopic boom 23 in closely spaced relation to the upstanding bracket 22 by which the telescopic boom 23 is pivoted to the carriage 19. The arrangement is such, as best illustrated in FIG. 3 of the drawings, to enable the operation of the piston and cylinder assembly 25 to move the telescopic boom in a vertical plane. The carriage 19 being movable along the elongated member 10 and the telescopic boom and at least one of its sections being movable with respect to the other enables the device to be moved in any desired direction so as to facilitate the quick and easy installation of the dart or closure D in the tap hole T of the converter 14.

Still referring to FIG. 1 of the drawings, it will be seen that broken lines indicate two alternate positions of the telescopic boom 23, the first of these showing the carriage 19 positioned adjacent the pivot 11 with the dart or closure D in front of the throat of the converter 14 and the second position showing the carriage in the same position as illustrated in solid lines and showing the dart or closure D positioned within the converter 14 in spaced relation to the tap hole T, while the solid lines in FIG. 1 of the drawings show the telescopic boom 23 moved downwardly with the dart or closure D partially engaged in the tap hole T.

In FIGS. 1 and 2 of the drawings, a vertically slotted shield 27 may be seen attached to the horizontal frame adjacent the wheeled support 15, the shield 27 being of a size sufficient to shield the device of the invention from the molten contents of the converter 14 when the device is operated to extend the telescopic boom 23 thereinto along with the dart or closure D and position the same in the tap hole T thereof.

Still referring to FIG. 1 of the drawings, an air operated piston and cylinder 28 will be seen attached to one of the sections of the telescopic boom 23 in that portion thereof slidably engaged in the adjacent section of the telescopic boom. The piston and cylinder assembly 28 is mechanically connected to the jaws 24 for operating the same to hold or release the dart or closure D. Flexible, preferably helically coiled air lines connect the piston and cylinder assembly 28 with the carriage 19 and the carriage 19 has flexible air lines connected therewith which are carried by the elongated channel 18 and which air lines extend to remote controls and air pressure supplies as will be understood by those skilled in the art. Similar flexible air lines positioned in the elongated channel 18 from remote controls and the air supply source extend to the piston and cylinder assembly 25 which is used to move the telescopic boom 23 vertically so as to pivot it on the upstanding bracket 22 of the carriage 19.

An additional piston and cylinder assembly 29 is mounted on the extreme right end of the telescopic boom 23 and is used for moving the telescopic extension of the telescopic boom 23 as necessary when the device is retracted or extended. Flexible air lines connect the piston and cylinder assembly 29 with the carriage 19 and still further flexible air lines carried in the elongated channel 18 extend to a remote control and the air source heretofore mentioned.

By referring now to FIG. 3 of the drawings, it will be seen that an air operated motor 30 is mounted on the extreme right end of the horizontal frame and the elongated member 10 thereof so as to drive a chain 31 trained over a double sprocket 32 rotatably mounted on the elongated member 10. A secondary chain 33 also trained over the double sprocket 32 extends longitudinally of the elongated member 10 of the horizontal frame to a point adjacent the opposite end where it is trained over a sprocket 34.

A clamp, not shown, on the carriage 19 engages the chain 33 so that actuation of the air operated motor 30 will move the carriage 19, the telescopic boom 23 and the piston and cylinder assembly 28 longitudinally of the elongated member 10 which action, along with the telescopic action of the telescopic boom 23, provides easily controlled accurate positioning of the dart or closure D with respect to the tap hole in the converter 14.

Still referring to FIG. 3 of the drawings, it will be seen that the flexible air lines hereinbefore referred to are generally indicated by the numeral 35 and that they lead to a terminal or connection box 36 from which electric or pneumatic control circuits 37 lead to a remote terminal box 38 and a manually actuated control panel 39.

It will occur to those skilled in the art that if desired a control device can be directly connected to and positioned on or adjacent to the dart positioning device itself and in FIG. 3 of the drawings such an optional or secondary control is indicated at 40 and connected by a control circuit 41 to a secondary control box 42 mounted on the carriage 19. An operator on the pouring floor defined by the platform 13 adjacent the converter 14 can thus control the device and its placement of the closure or dart D if desired at this location.

It will be obvious that limit switches are provided with respect to the travel of the carriage 19 along the horizontal frame and the elongated member 10 thereof in particular and it will also be obvious that a supply source for electrical energy and air pressure is necessary to operate the device, although the same is not shown or otherwise disclosed herein.

It will thus be seen that a relatively simple and highly efficient device for placing slag retention devices in tapping converters has been disclosed which is considerably less expensive to construct and much easier to operate than the devices of the prior art and particularly the devices of prior art U.s. Pat. Nos. 4,431,169, 4,478,392 and 4,468,013.

It will be appreciated that the device is important to the steelmaking industry in supplying the demand for slag-free steel which necessitates blocking the flow of slag from a steel producing furnace or converter when most of the molten steel has been removed and the layer of slag, which normally floats on the steel, is approaching the tap hole.

Having thus described my invention, what I claim is:

1. Apparatus for forcefully moving a slag retaining device through molten metal and a slag layer thereon into a tap hole in a converter comprising a horizontally disposed elongated frame movably positioned on a platform adjacent said converter, a fixed pivotal support on said platform, a first end of said elongated frame pivoted to said pivotal support, wheels on a second end of said elongated frame engaging said platform whereby said second end can move horizontally in an arcuate path on said platform, a carriage movable along said elongated frame and means for moving said carriage, a pivot on said carriage, a two-part telescopic supporting boom, a first part of said two-part supporting boom being pivotally attached inwardly of one end thereof to said pivot on said carriage, a second part of said two-part supporting boom being movable longitudinally of said first part so that said supporting boom is extensible into and out of said converter and collapsible upon itself, and means for moving said second part of said supporting boom with respect to said first part of said supporting boom, said pivot on said carriage forming a fulcrum for said supporting boom and means on said carriage for tilting said supporting boom relative to said pivot and carriage whereby the ends of said supporting boom are movable in vertical and horizontal arcuate paths and means on one end of said second part of said supporting boom detachably supporting said slag retaining device whereby said slag retaining device may be moved toward and away from said converter and said tap hole therein on said horizontal and vertical paths.

2. The apparatus for placing a slag retaining device in a tap hole in a converter set forth in claim 1 and wherein said means for moving said second supporting boom part includes a piston and cylinder in said first supporting part engaging said second supporting boom part for imparting longitudinal movement thereto.

3. The apparatus for placing a slag retaining device in a tap hole in a converter set forth in claim 1 wherein said means on said carriage for tilting said supporting boom comprises a mechanism operable to raise and lower said supporting boom.

* * * * *